US007242382B2

(12) United States Patent
Murakami

(10) Patent No.: US 7,242,382 B2
(45) Date of Patent: Jul. 10, 2007

(54) DISPLAY DEVICE HAVING REDUCED NUMBER OF SIGNAL LINES

(75) Inventor: Hiroshi Murakami, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 415 days.

(21) Appl. No.: 09/314,750

(22) Filed: May 19, 1999

(65) Prior Publication Data

US 2002/0075220 A1 Jun. 20, 2002

(30) Foreign Application Priority Data

May 22, 1998 (JP) ..... 10-141499

(51) Int. Cl.
*G09G 3/36* (2006.01)

(52) U.S. Cl. ..... 345/98; 345/204

(58) Field of Classification Search ..... 345/98, 345/99, 100, 101, 102, 103, 93, 84, 90, 204, 345/537, 538

See application file for complete search history.

(56) References Cited

U.S. PATENT DOCUMENTS 5,010,324 A * 4/1991 Yamamoto ..... 345/684
5,168,270 A * 12/1992 Masumori et al. ..... 340/784
5,333,261 A * 7/1994 Guttag et al. ..... 345/501
5,594,908 A * 1/1997 Hyatt ..... 395/800
5,712,652 A * 1/1998 Sato et al. ..... 345/90
5,714,985 A * 2/1998 Kawamura et al. ..... 345/520
5,815,136 A * 9/1998 Ikeda et al. ..... 345/98
5,818,558 A * 10/1998 Ogishima ..... 349/110
5,828,592 A * 10/1998 Tran et al. ..... 365/45
5,912,651 A * 6/1999 Bitzakidis et al. ..... 345/58
6,011,534 A * 1/2000 Tanaka et al. ..... 345/98
6,115,020 A * 9/2000 Taguchi et al. ..... 345/99
6,121,949 A * 9/2000 Ramamurthy et al. ..... 345/101
6,598,136 B1 * 7/2003 Norrod et al. ..... 711/165

FOREIGN PATENT DOCUMENTS

JP 07-175445 7/1995
JP WO97/06482 2/1997
JP 09-105904 4/1997

* cited by examiner

*Primary Examiner*—Richard Hjerpe
*Assistant Examiner*—Jean Lesperance
(74) *Attorney, Agent, or Firm*—Greer, Burns, & Crain , Ltd.

(57) ABSTRACT

A display device includes a display unit which displays an image, memories which store information regarding control of the display unit, an operation circuit unit which controls the display unit to display the image based on the information stored in the memories, a data bus which connects the memories to an exterior of the display device, and supplies the information to the memories from the exterior of the display device, and an address bus which connects the memories to the exterior of the display device, and supplies address signals for selecting one of the memories.

1 Claim, 12 Drawing Sheets

DISPLAY DEVICE HAVING REDUCED NUMBER OF SIGNAL LINES

BACKGROUND OF THE INVENTION

1. Field of the Invention

The present invention generally relates to display devices, and particularly relates to a display device which allows complex image information such as letters and pictures to be displayed and input via a liquid crystal display.

2. Description of the Related Art

In recent years, development of information technology has created a demand for a small-size display device which allows complex information to be displayed and input via screen.

FIG. 1 is a block diagram of a liquid crystal display device (hereinafter referred to as an LCD device) as an example of a related-art display device.

In FIG. 1, an LCD 200 includes operation circuits CIR1 through CIR2$^m$, the total number of which is $2_m$. Each of the operation circuits CIR1 through CIR2$^m$ includes a driver, a check circuit, a tablet detection circuit, etc. The LCD 200 further includes a display unit 2 which displays information on an LCD screen.

The LCD 200 is connected to a control device 150, which controls operations of the LCD 200. A plurality of signal lines connect between the control device 150 and the LCD 200 to exchange information therebetween. When a display operation is to be performed, drivers of the operation circuits operate based on information supplied from the control device 150 so as to activate a liquid crystal element corresponding to the supplied information. When input is entered via a pen touch on the display unit 2, information corresponding to a position of the pen touch is forwarded from coordinate-detection circuits of the operation circuit to the control device 150.

The number of signal lines connecting between the control device 150 and the LCD 200 needs to be the total number of bits of all the operation circuits. When each of the $2^m$ operation circuits CIR1 through CIR2$^m$ has a n-bit configuration, for example, the number L0 of the signal lines between the control device 150 and the LCD 200 needs to be $2^m \times n$.

Since the signal lines between the control device 150 and the LCD 200 are as many as the total number of bits of the operation circuits, the following problem is encountered in such a configuration. That is, when the LCD 200 is designed for displaying and inputting of complex information, the number of the operation circuits and the number of bits of each operation circuit are increased. In such a case, the number of signal lines and the number of connection terminals become larger, resulting in a cost increase regarding signal-line connections. Further, an increase in the number of terminals leads to the number of components for the LCD 200 and the control device 150 being increased. This means a rise in manufacturing costs of the LCD 200 and the control device 150, and, also, results in the LCD 200 and the control device 150 having larger sizes.

In consideration of this, the operation circuits of the related-art LCD 200 tend to employ a simple structure, giving priority to miniaturization of the LCD 200 over enhanced functions of displaying and inputting of sophisticated information.

Accordingly, there is a need for a display device which allows complex information to be displayed and input via a screen thereof without increasing the number of signal lines between the display device and a control circuit as well as the number of circuit components of the display device and the control circuit.

SUMMARY OF THE INVENTION

Accordingly, it is a general object of the present invention to provide a display device which can satisfy the need described above.

It is another and more specific object of the present invention to provide a display device which allows complex information to be displayed and input via a screen thereof without increasing the number of signal lines between the display device and a control circuit as well as the number of circuit components of the display device and the control circuit.

In order to achieve the above objects according to the present invention, a display device includes a display unit which displays an image, memories which store information regarding control of the display unit, an operation circuit unit which controls the display unit to display the image based on the information stored in the memories, a data bus which connects the memories to an exterior of the display device, and supplies the information to the memories from the exterior of the display device, and an address bus which connects the memories to the exterior of the display device, and supplies address signals for selecting one of the memories.

In the device described above, the number of signal lines connecting between the display device and the exterior of the display device is as small as the number of the address bus lines plus the number of the data bus lines, yet is sufficient for controlling the display device because of use of the memories. This configuration can reduce the number of signal lines and the number of connection-purpose components of the display device compared to the related-art display device. Such a reduction in the number of components leads to a further miniaturization of the display device and the exterior control device. Where a computer is employed as the exterior control device, software installed in the computer is used for controlling the display device.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 2:
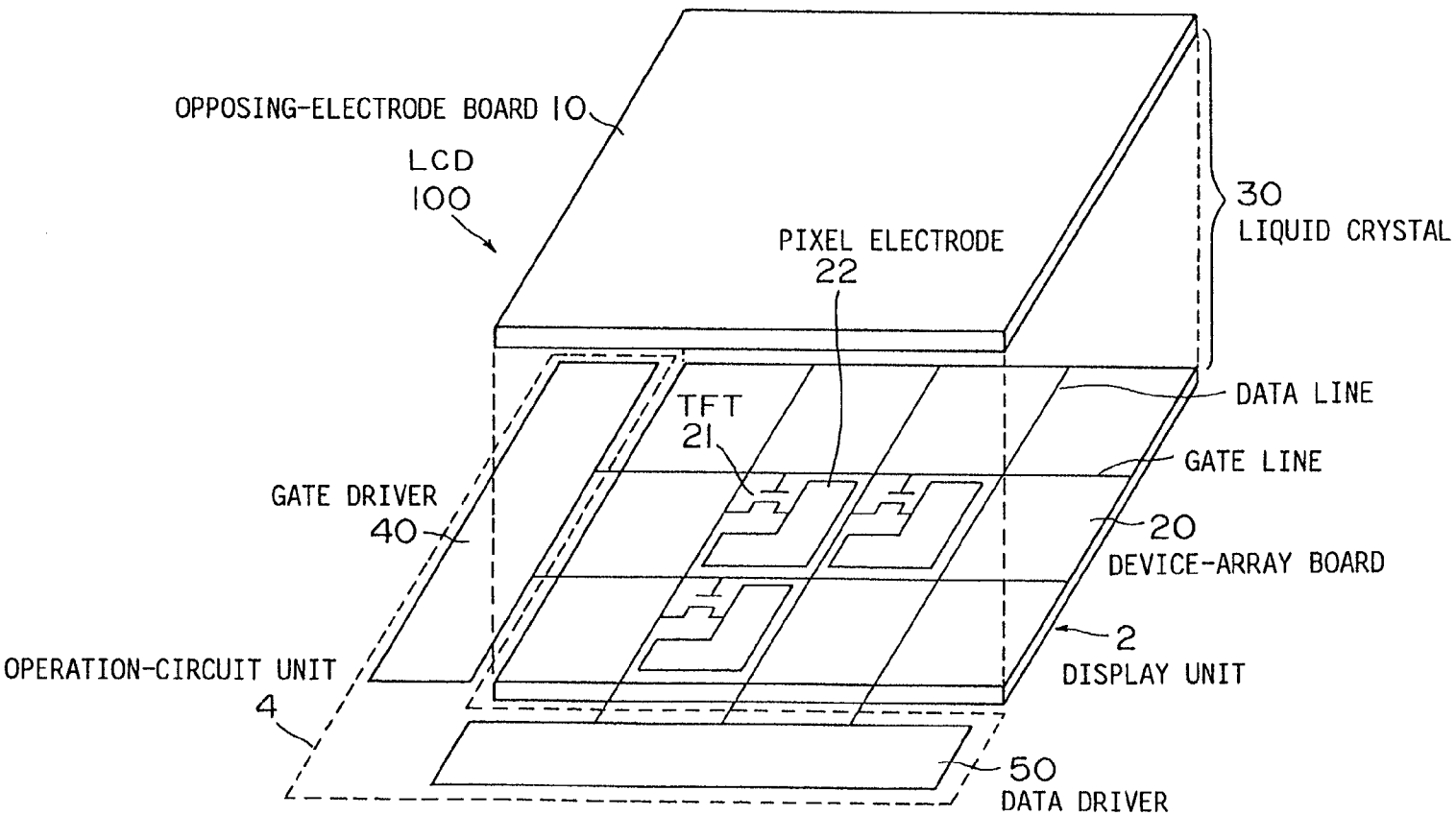
FIG. 2 is an illustrative drawing showing a configuration of an AM-LCD of a three-terminal-device type.

FIG. 2 is an illustrative drawing showing a configuration of an AM-LCD (active matrix liquid crystal display) 100 of a three-terminal-device type. Hereinafter the AM-LCD 100 is simply referred to as an LCD 100.

The LCD 100 includes a display unit 2 and a operation-circuit unit 4. The display unit 2 includes an opposing-electrode board 10, a device-array board 20, and a liquid crystal 30. The operation-circuit unit 4 includes a gate driver 40 and the data driver 50.

The device-array board 20 has a plurality of gate lines and data lines arranged thereon in a matrix form. Outside the extension of the device-array board 20, the gate lines are connected to the gate driver 40, and the data lines are connected to the data driver 50.

At each intersection between the gate lines and the data lines, a TFT (thin film transistor) 21 is provided as a three-terminal device. The TFT 21 serves as a switch for each pixel, which is a unit of display in the LCD 100. The TFT 21 has a gate electrode thereof connected to a gate line, a drain electrode thereof connected to a data line, and a source electrode connected to a pixel electrode 22.

The LCD 100 is driven by an alternating voltage which changes a polarization thereof at every display frame. If a direct current is applied to the liquid crystal 30 for a long duration, material characteristics of the liquid crystal are changed, which leads to a degradation of display characteristics such as a decrease in resistance. This is the reason why the alternating voltage is used.

When the LCD 100 is to be driven, the gate driver 40 supplies address signals to the gate lines, and controls an on/off state of the TFTs 21 via the address signals that are applied to the respective gates thereof. The data driver 50 supplies display-data signals to the data lines. The display-data signals change their polarization once in each frame-scan period. Passing through the TFTs 21 that are turned on, the display-data signals enter the pixel electrodes 22. Liquid crystal on each pixel electrode 22 is driven according to a difference between a voltage of the display-data signal supplied to the pixel electrode 22 and a voltage of the opposing-electrode board 10, thereby displaying information on an entire screen.

The TFT 21 may be implemented via an a-Si (amorphous silicon) TFT, a p-Si (polysilicon) TFT, a CdSe semiconductor, a Te semiconductor, etc. The a-Si TFT is formed by etching a thin film of non-crystalline silicon that is formed on a glass board via vapor deposition or sputtering. The p-Si TFT is formed by decomposing and vapor-sputtering $SiH_4$, $Si_6H_6$, or the like on a quartz board via a decompressed CVD method. Use of the p-Si TFT makes it possible to integrate the operation circuits such as the gate driver 40 and the data driver 50 on the same board with the display unit 2. This simplifies lead connections between the operation circuits and the display unit 2, assisting further miniaturization of the LCD 100.

In FIG. 2, the numbers of the gate lines, the data lines, the TFTs 21, the pixel electrodes 22 are shown only for the illustration purpose, and are not limited to what is shown in FIG. 2.

Figure 3:
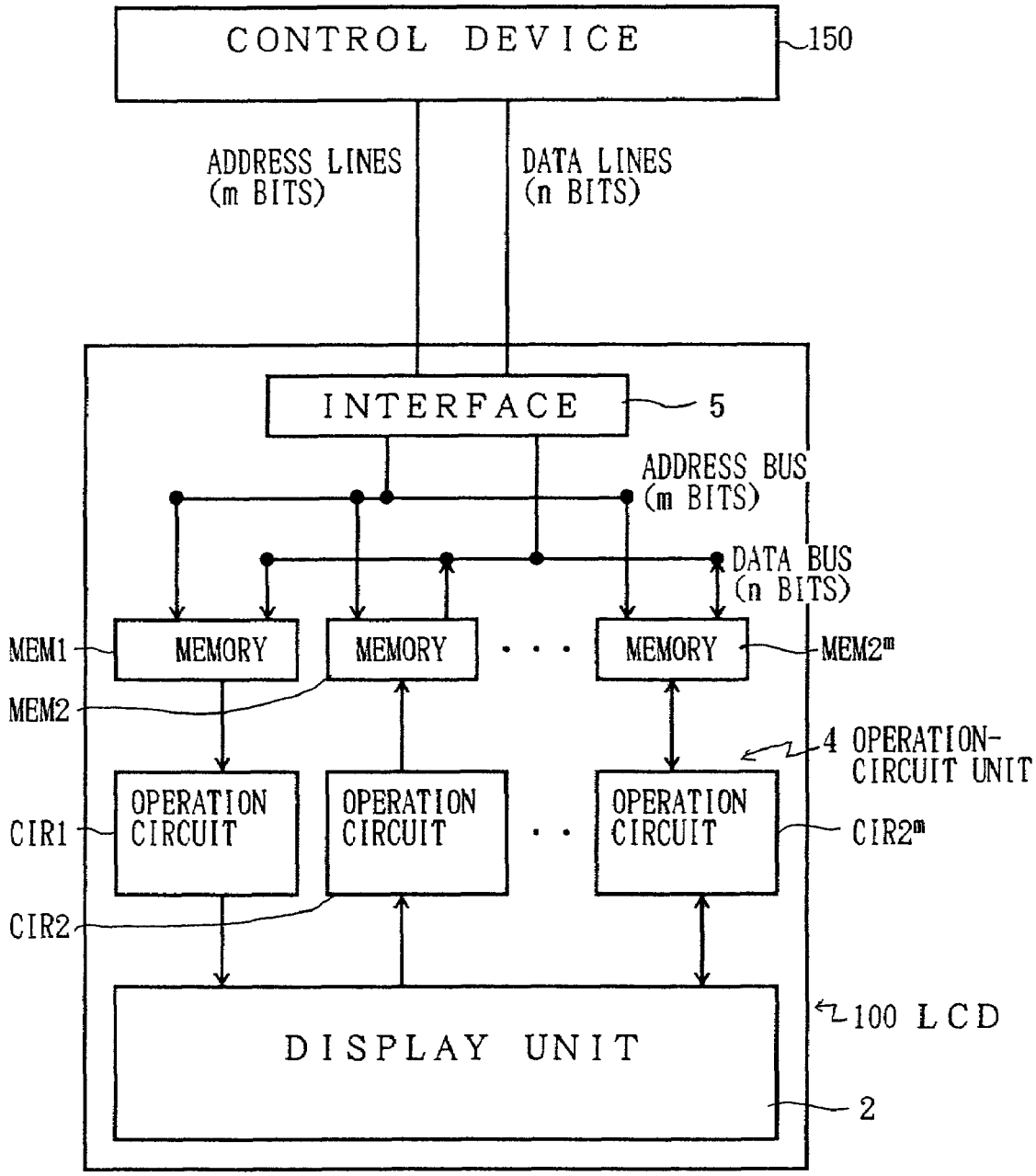
FIG. 3 is a block diagram showing a configuration of a display device according to a principle of the present invention.

FIG. 3 is a block diagram showing a configuration of a display device according to a principle of the present invention. The principle of the present invention is applied to the LCD 100 as described above, for example. In the following, the principle of the present invention will be described with reference to FIG. 3.

As shown in FIG. 3, the LCD 100 includes the display unit 2, the operation-circuit unit 4, and an interface 5. The operation-circuit unit 4 includes memories MEM1 through MEM2$^m$ and the operation circuits CIR1 through CIR2$^m$. There are an m-line address bus and an n-line data bus in the LCD 100. The address bus and the data bus are connected to the interface 5 and to the memories MEM1 through MEM2$^m$.

The memories MEM1 through MEM2$^m$ are connected to the operation circuits CIR1 through CIR2$^m$, respectively. Each of the memories MEM1 through MEM2$^m$ has a unique address assigned thereto. When an address is specified by address signals, a memory corresponding to the specified address exchanges information with the data bus.

The operation circuits CIR1 through CIR2$^m$ operate according to the contents of the corresponding memories, or are equipped with a function to write information in the corresponding memories. The operation circuits CIR1 through CIR2$^m$ includes drivers for driving the display unit 2, detection circuits for detecting abnormalities of the LCD 100, detection circuits for detecting coordinates of a pen touch when input is entered via the pen touch on the screen of the LCD 100, etc.

The control device 150 for the purpose of operation control is connected to the LCD 100. The m address lines and the n data lines connect between the interface 5 of the LCD 100 and the control device 150.

Figure 1:
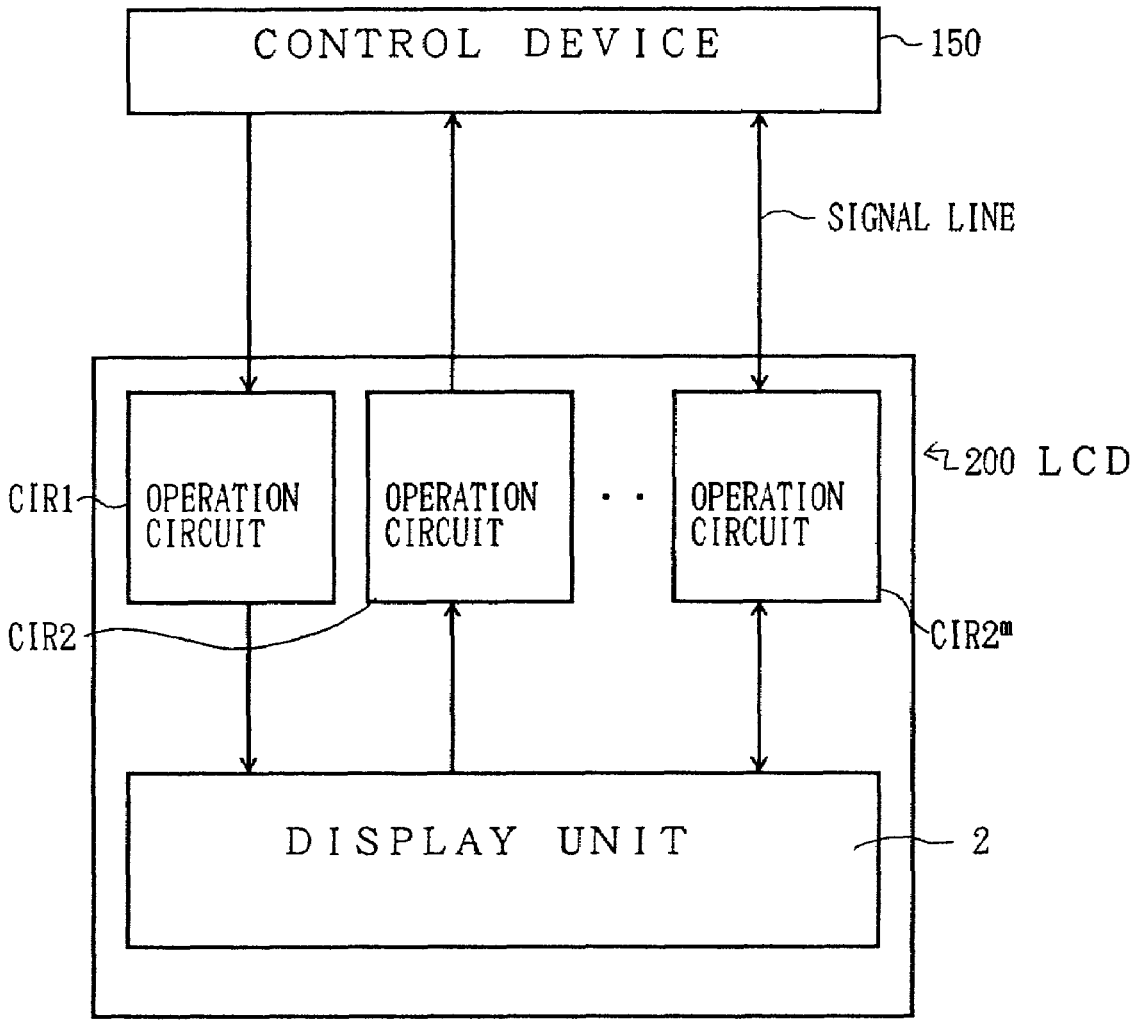
FIG. 1 is a block diagram of a liquid crystal display device of the related art.

In the LCD 100 as described above, the number L1 of signal lines connecting between the LCD 100 and the control device 150 is m+n. In contrast, the number L0 of signal lines in the related-art LCD 200 described in connection with FIG. 1 is $n\times2^m$. If m and n are 4 and 8, respectively, and each of the LCD 100 and the LCD 200 is comprised of 8-bit operation circuits as many as 16 ($2^4$), then, the number L0 of signal lines connecting the related-art LCD 200 and the control device 150 is 128 (=8×16). On the other hand, the number L1 of the signal lines connecting between the LCD 100 and the control device 150 is as small as 12 (=4+8).

In this manner, the LCD 100 of the present invention needs a much smaller number of signal lines for connection with the control device 150 than does the related-art LCD 200. Because of the smaller number of signal lines, the number of connection terminals of the LCD 100 and the control device 150 can also be smaller, resulting in a size and a manufacturing cost of the LCD 100 and the control device 150 being reduced. The advantage of having a reduced number of signal lines is more prominent as the numbers n and m are increased. This is apparent from a comparison between L1 (=m+n) and L0 (=$n\times2^m$).

Since the operation control of the operation circuits CIR1 through CIR2$^m$ of the LCD 100 is conducted by using the address bus and the data bus, this configuration provides a high degree of compatibility with personal computers or the like. Because of this, it is possible to connect the LCD 100 to an extension board of a personal computer and to use software installed in the personal computer for controlling the operations of the LCD 100.

The number of the memories and the operation circuits as well as the number n of bits are not limited to the examples shown in the above. Further, the number of memories in the LCD 100 may not be the same as that of the operation circuits.

In what follows, details of the LCD 100 will be described according to the present invention.

Figure 4:
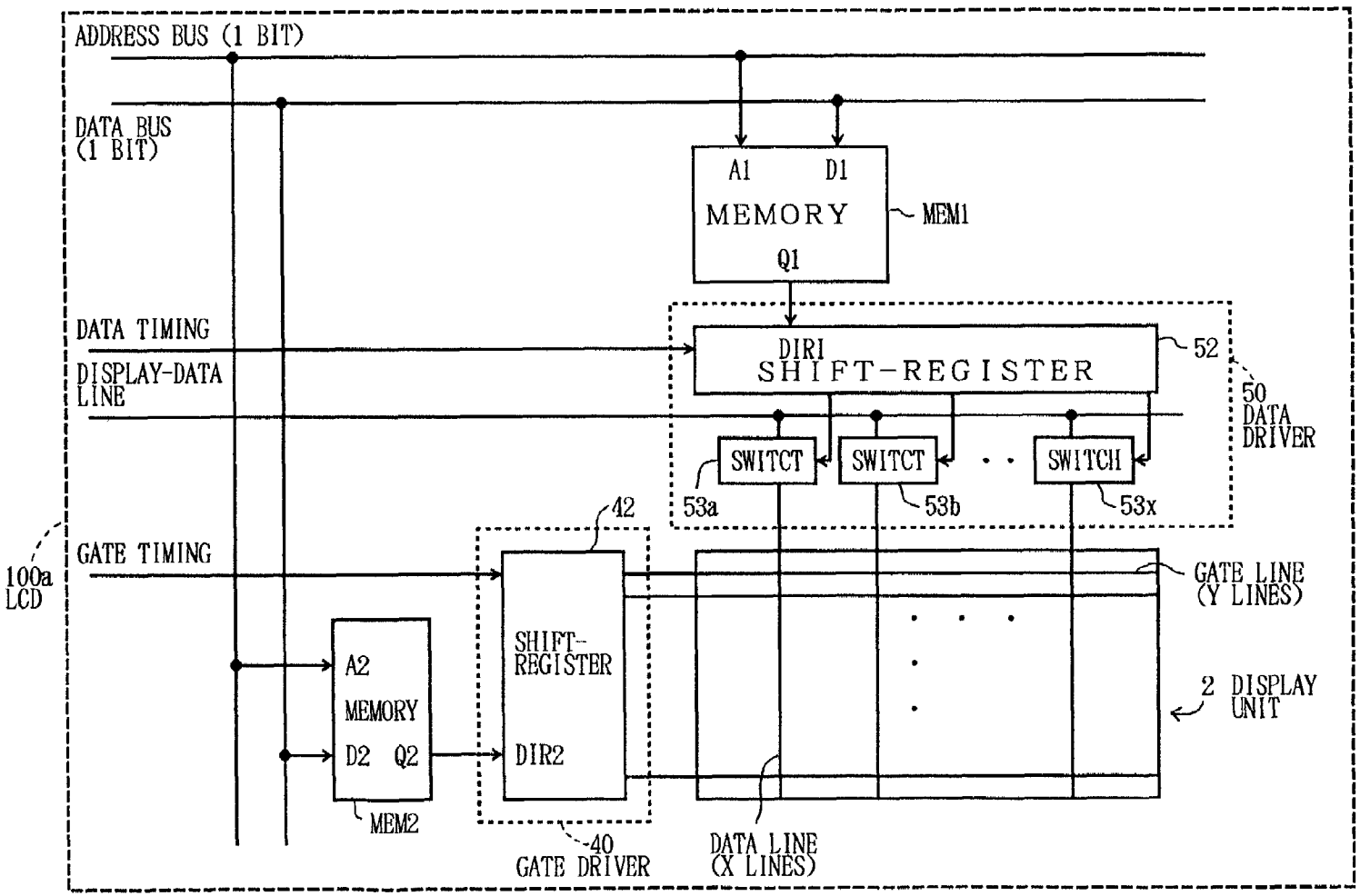
FIG. 4 is a block diagram of an LCD device according to a first embodiment of the present invention.

FIG. 4 is a block diagram of an LCD 100*a* according to a first embodiment of the present invention.

As shown in FIG. 4, the LCD 100*a* includes the display unit 2, the gate driver 40, the data driver 50, and one-bit memories MEM1 and MEM2. The gate driver 40 includes a shift-register 42, and the data driver 50 includes a shift-register 52 and switches 53*a* through 53*x*.

There are Y gate lines and X data lines arranged in the display unit 2. The gate lines are connected to the shift-register 42, and the data lines are connected to display-data lines via the switches 53*a* through 53*x*. The display-data lines convey display data. The switches 53*a* through 53*x* may be comprised of sampling circuits. The shift-register 52 is connected to and controls an on/off state of each of the switches 53*a* through 53*x*.

The shift-registers 52 and 42 have shift-direction-control inputs DIR1 and DIR2, respectively, which are connected to output nodes Q1 and Q2 of the memories MEM1 and MEM2, respectively. The memories MEM1 and MEM2 have respective address inputs A1 and A2 which are connected to the same address-bus line, and, also, have respective data inputs D1 and D2 which are connected to the same data-bus line.

The operation control of the shift-registers 42 and 52 is conducted in synchronism with respective timing clocks supplied from an external timing generation circuit (not shown).

Figure 5:
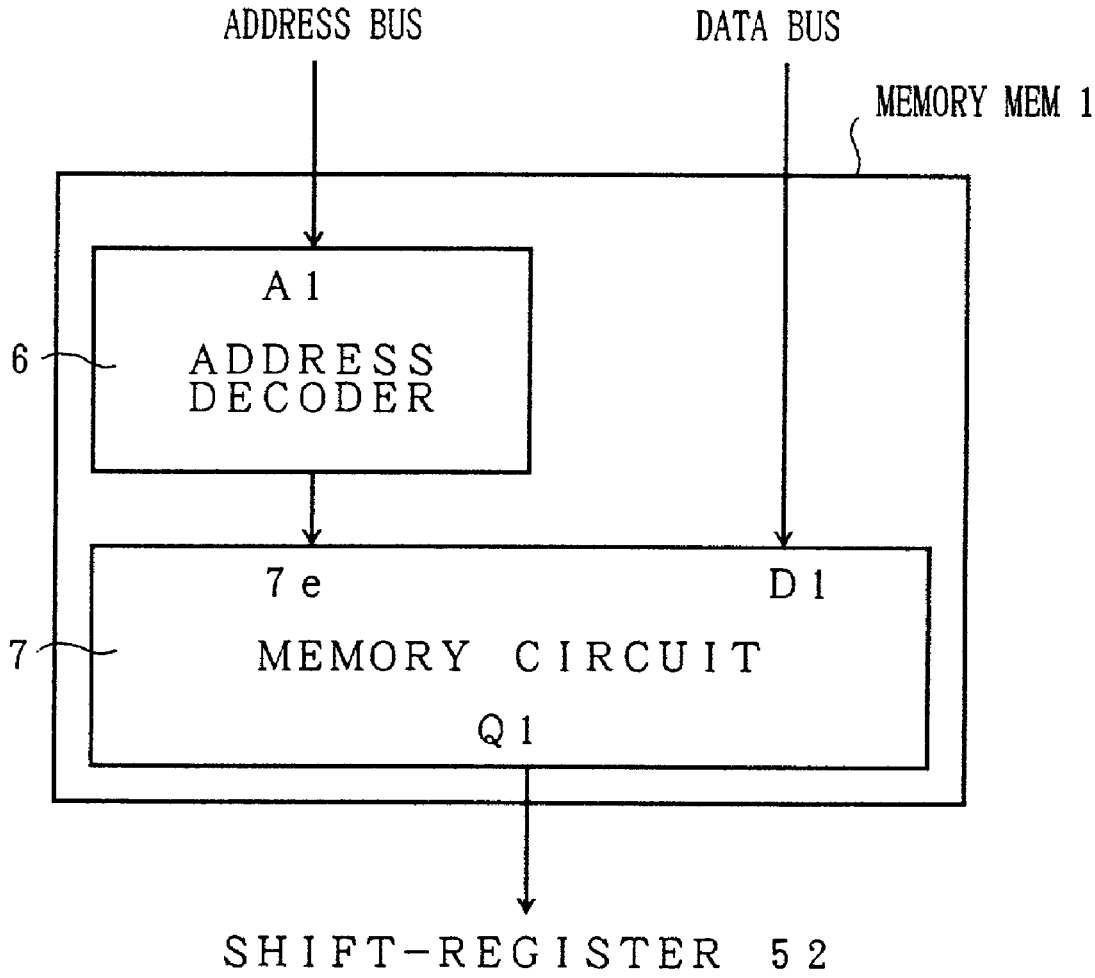
FIG. 5 is a block diagram showing a configuration of a memory MEM1.

FIG. 5 is a block diagram showing a configuration of the memory MEM1.

The memory MEM1 includes an address decoder 6 and a memory circuit 7. The address decoder 6 outputs a high-level signal as a decoding result when an address assigned to the memory MEM1 is input via the address input A1. The memory circuit 7 acquires data from the data bus via the data input D1 when a high-level signal is input to an enable node 7*e* from the address decoder 6. The acquired data is stored in the memory circuit 7, which constitutes a data-write operation. Alternatively, the memory circuit 7 may be designed such that the memory circuit 7 outputs data stored therein to the data bus when a high-level signal is input to the enable node 7*e* from the address decoder 6. The outputting of data to the data bus in this case constitutes a data-read operation. When a low-level signal is input to the enable node 7*e* of the memory circuit 7, the memory circuit 7 is not connected to the data bus, and maintains a high-impedance output state thereof.

The memory MEM2 has the same configuration as the memory MEM1, and a description thereof will be omitted.

The LCD 100*a* is of a type that performs a successive-point operation. When a display operation is to be performed, a memory that corresponds to an address indicated by address signals on the address bus receives information from the data bus, and stores the information therein. Then, the shift-register 42 successively scans the gate lines according to the information stored in the memory MEM2, and turns on the TFTs 21 of a gate line that is being scanned. The shift-register 52 turns on a switch according to the information stored in the memory MEM1. A data line connected to the switch that is turned on receives display data, so that the display data passes through one of the TFTs 21 connected to the data line when the one of the TFTs 21 is turned on. The display data is thus supplied to the pixel electrode connected to the turned-on TFT 21, and liquid crystal on the pixel electrode displays the display data.

In this manner, the LCD 100*a* includes the gate driver and the data driver that are comprised of the shift-register 42 and the shift-register 52, respectively, and the scan directions of the shift-registers 42 and 52 can be controlled via the signals on the address bus and the data bus. Because of this configuration, when the LCD 100*a* is connected to a computer, software installed in the computer can be used for controlling the scan directions of the LCD 100*a*. Use of such a configuration makes it possible to achieve reversed display in a horizontal direction as well as in a vertical direction, for example.

Here, the number of bits in the memories MEM1 and MEM2 or the number of bits used in any other parts of the configuration is not limited to the above-disclosed example.

Figure 6:
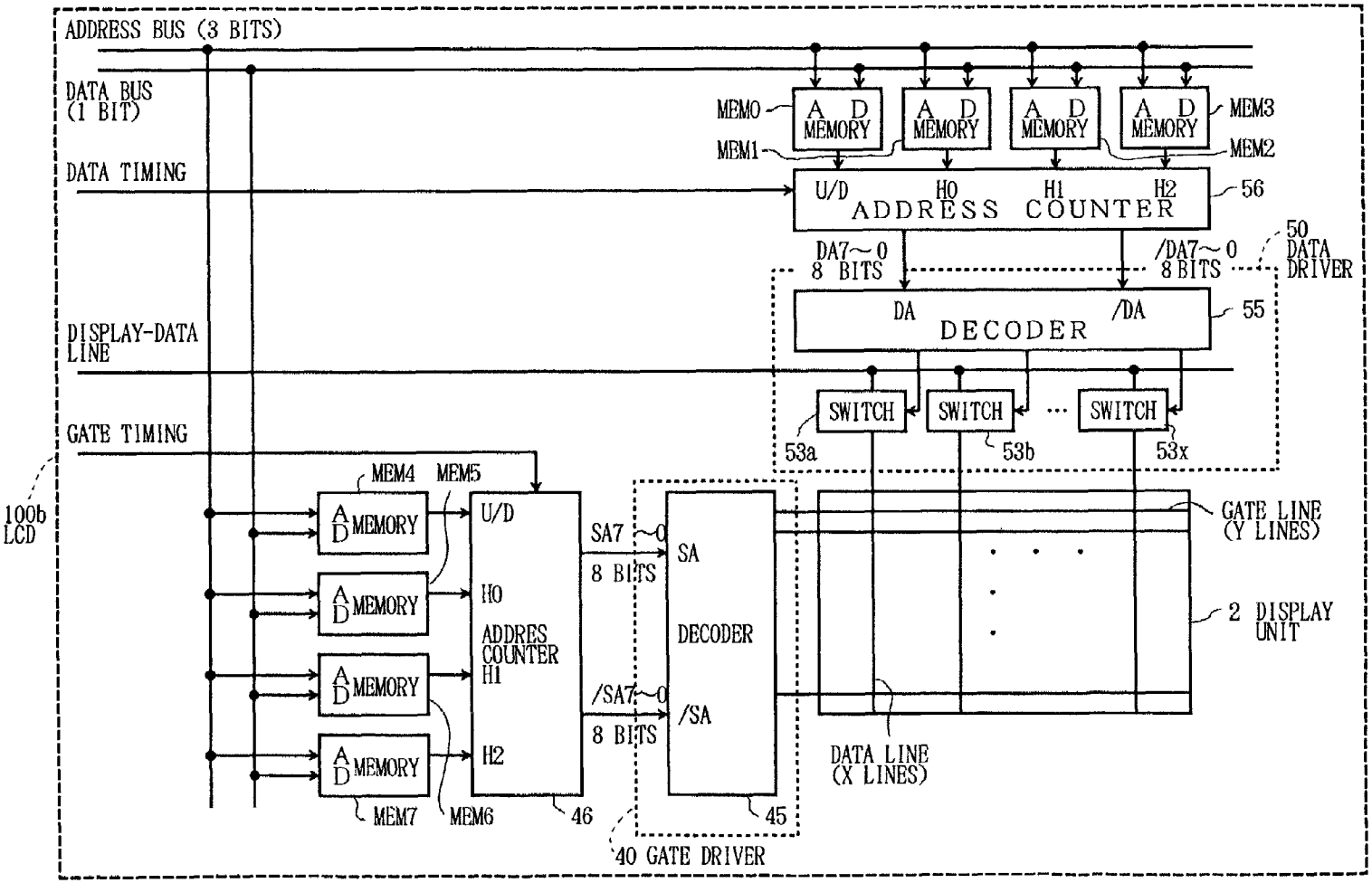
FIG. 6 is a block diagram of an LCD device according to a second embodiment of the present invention.

FIG. 6 is a block diagram of an LCD 100*b* according to a second embodiment of the present invention.

As shown in FIG. 6, the LCD 100*b* includes the display unit 2, one-bit memories MEM0 through MEM7, an address counter 46, and an address counter 56. The LCD 100*b* further includes a decoder 45 as the gate driver 40 as well as the switches 53*a* through 53*x* and a decoder 55 as the data driver 50. As shown here, the LCD 100*b* employs the decoders 45 and 55 in place of the shift-registers 42 and 52 in comparison with the LCD 100*a* of the first embodiment. Here, the same elements as those of the LCD 100*a* of the first embodiment are referred to by the same numerals, and a description thereof will be omitted.

Each of the memories MEM0 through MEM7 has an address input thereof connected to a 3-bit address bus, and has an information input thereof connected to a one-bit data bus. Outputs of the memories MEM0 through MEM3 are connected to inputs U/D, H0, H1, and H2 of the address counter 56, respectively, and outputs of the memories MEM4 through MEM7 are connected to inputs U/D, H0, H1, and H2 of the address counter 46, respectively.

Based on information from the memories, the address counters 46 and 56 generate addresses for the decoders 45 and 55, respectively. The operation control of the address counters 46 and 56 is conducted in synchronism with respective timing clocks supplied from an external timing generation circuit (not shown).

The decoders 45 and 55 operate based on the addresses generated by the address counters 46 and 56, respectively, so as to effect a display operation with respect to the display unit 2.

Figure 7:
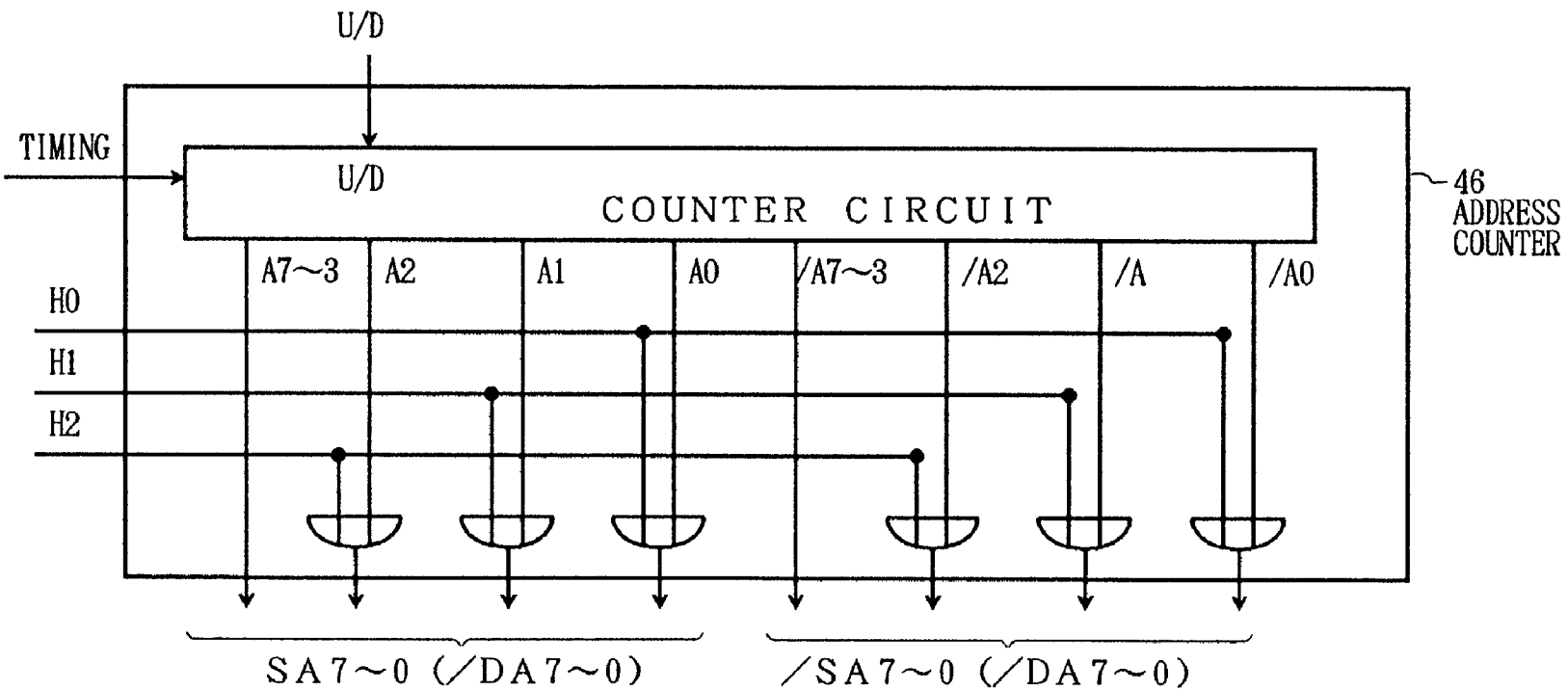
FIG. 7 is an illustrative drawing showing a configuration of an address counter.

FIG. 7 is an illustrative drawing showing a configuration of the address counter 46. It should be noted that the address counter 56 has the same configuration as the address counter 46.

The LCD 100*b* as described above can not only be controlled via the address bus and the data bus, but also control scan orders via control of the address counters. In the address counter 46 shown in FIG. 7, when the memories MEM5 through MEM7 supply a high-level signal, a low-level signal, and a low-level signal to the input H0, H1, and H2 of the address counter 46, respectively, the least significant bits A0 and /A0 of the output of the address counter 46 are always high. When the least significant bits A0 and /A0 are high, the gate driver 40 simultaneously supplies a selection pulse to an odd-number line and an even-number line of the gate lines. Because of this, there is no distinction between the odd-number lines and the even-number lines of the gate lines, and two lines are simultaneously selected and scanned. Such a scheme is used when an image having a low resolution is displayed on the entire display unit 2. Since the LCD 100*b* can be controlled via the address bus and the data bus, a system in which a display mode can be switched by use of software installed in a computer can be constructed, and can be used in such a case where there is a need to display an image having a lower resolution from time to time.

Further, use of memories in the LCD 100*b* makes it possible to reduce the number of signal lines between the LCD 100*b* and the control device 150. Therefore, the present invention can provide the LCD 100*b* and the control device 150 having simpler structures than the otherwise.

It should be noted that configurations of the address counters 46 and 56 are not limited to those shown in FIG. 7. Also, the number of bits in memories and the number of bits in other parts of the structure can be changed according to design requirements.

Figure 8:
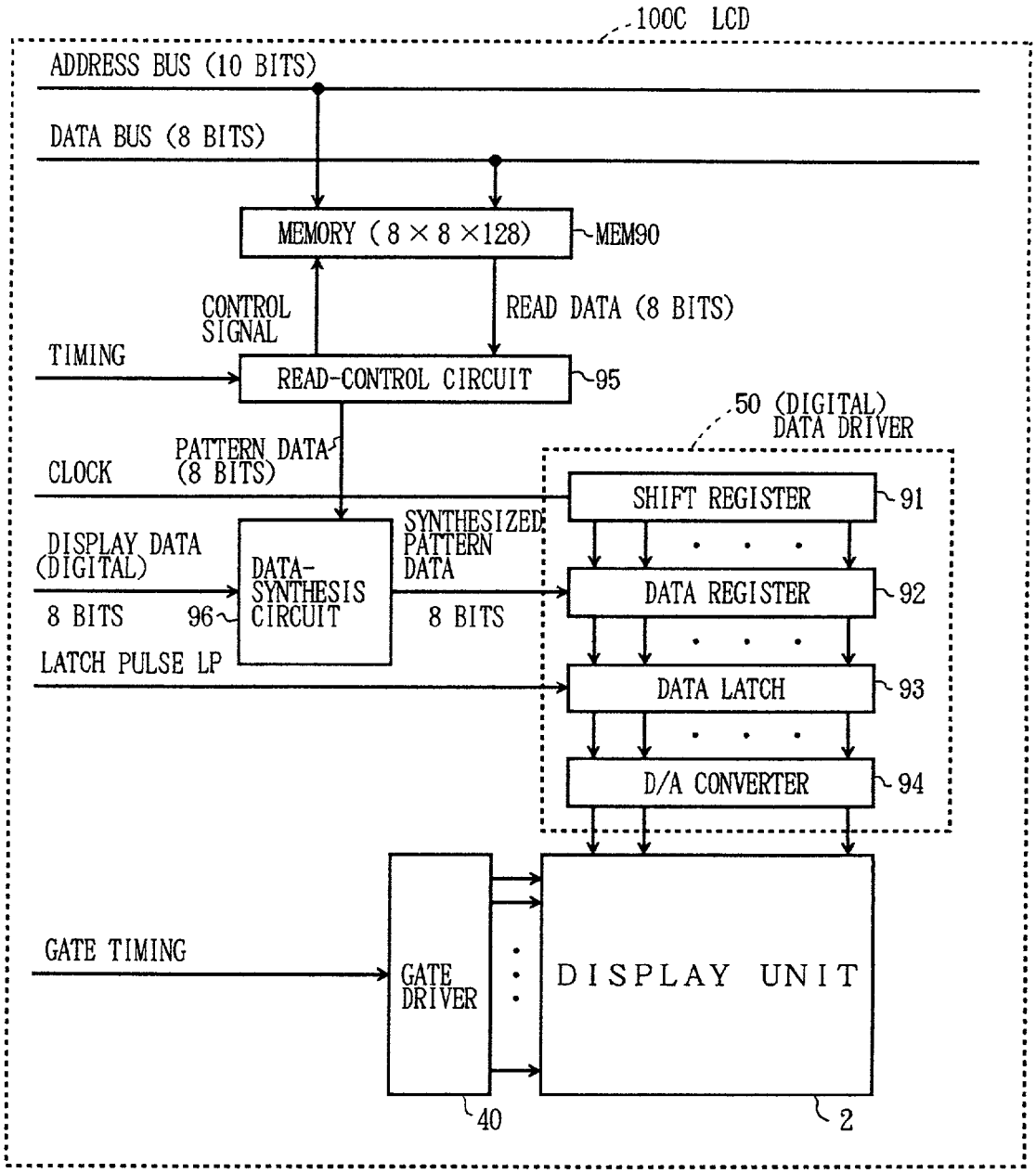
FIG. 8 is a block diagram of an LCD device according to a third embodiment of the present invention.

FIG. 8 is a block diagram of an LCD 100*c* according to a third embodiment of the present invention.

As shown in FIG. 8, the LCD 100*c* includes the display unit 2, the gate driver 40, a memory MEM90, a read-control circuit 95, a data-synthesis circuit 96, and the data driver 50. The data driver 50 includes a shift register 91, a data register 92, a data latch 93, and a D/A converter 94. Here, the same elements as those of the LCD 100*a* of the first embodiment are referred to by the same numerals, and a description thereof will be omitted.

The memory MEM90 has a capacity to store 8-×-8-bit-pattern data as many as 128 patterns. The memory MEM90 has a data input A thereof connected to a 10-bit address bus, and has a data input thereof connected to an 8-bit data bus. The memory MEM90 receives pattern data by a unit of 8 bits via the data bus, and stores the received pattern data therein. Here, a pattern may be a character string, a picture, etc. For example, a pattern may be a test pattern, a caption, or a mode-display pattern such as "volume".

At such timings as indicated by the external source, the read-control circuit 95 successively reads pattern data from the memory MEM90, and supplies the pattern data to the data-synthesis circuit 96 as synthesis-purpose pattern data.

The data-synthesis circuit 96 combines the synthesis-purpose pattern data and digital display data supplied from an external source by performing an exclusive OR operation between the two patterns. Synthesized pattern data is stored in the data register 92.

The LCD 100*c* is of a type that performs a successive-line operation. The shift register 91, the data register 92, the data latch 93, and the D/A converter 94 together serve as a digital data driver. The synthesized data supplied to the digital data driver is transferred from the data register 92 to the data latch 93 where the data is latched. The synthesized data is then supplied from the data latch 93 to the D/A converter 94 at a timing of a latch pulse LP supplied from an external source. The D/A converter 94 provided at the last processing stage of the digital data driver converts the synthesized data into analog data, and supplies the analog data to the display unit 2.

The LCD 100*c* as described above can display a desired complex pattern, yet has connection lines as few as 18(=10+8) lines, which shows a stark contrast with the size of data that can be stored in the memory MEM90. This configuration thus provides a less expensive LCD having a smaller size.

The number of bits of the patterns and/or the number of patterns are limited to those of the above example. Further, when it is desired to change volume, only a character string "volume" can be stored in the memory, and when it is desired to change brightness, only a character string "bright" can be stored in the memory. In this manner, the memory MEM90 may store only a necessary pattern without storing all the patterns that may become necessary. This makes it possible to use a memory of a smaller capacity as the memory MEM90.

Figure 9:
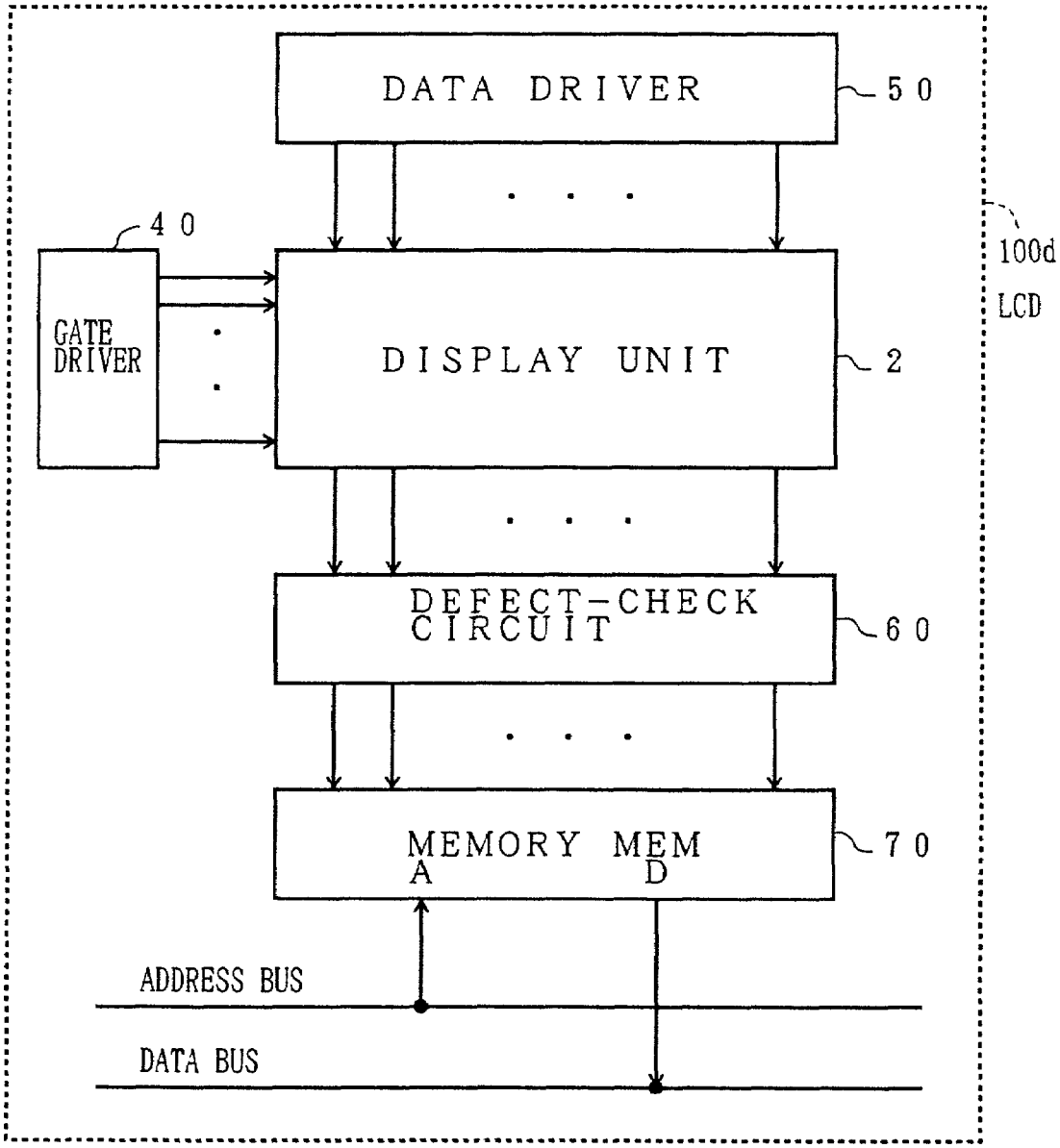
FIG. 9 is a block diagram of an LCD device according to a fourth embodiment of the present invention.

FIG. 9 is a block diagram of an LCD 100*d* according to a fourth embodiment of the present invention.

As shown in FIG. 9, the LCD 100*d* includes the display unit 2, the gate driver 40, the data driver 50, a defect-check circuit 60, and a memory MEM70. Here, the same elements as those of the LCD 100*a* of the first embodiment are referred to by the same numerals, and a description thereof will be omitted.

The defect-check circuit 60 is connected to the memory MEM70. The memory MEM70 has an address input thereof connected to an address bus, and has a data input thereof connected to a data bus.

The defect-check circuit 60 is used for checking if there is any defect in the display unit 2, and is connected to the data lines. If the display unit 2 has a defective part, information about the defective part is supplied to the defect-check circuit 60 via the data lines. The information about the defective part is processed by the defect-check circuit 60, and is output as a check result. The check result output from the defect-check circuit 60 is stored in a predetermined location in the memory MEM70.

When there is a need to check the presence/absence of a defect or obtain the information about a defect location from the outside of the LCD 100*d*, The check result stored at a memory location in the memory MEM70 indicated by address signals is read via the data bus. Here, the defect-check circuit 60 may alternatively be connected to the gate lines rather than to the data lines.

The LCD 100*d* as described above allows a check result to be read via a small number of signal lines, so that a check of the LCD 100*d* can be efficiently made without having a complex set of signal connections with the control device 150 and without requiring a complex design for the control device 150. If a defect check is made with respect to a TFT substrate at a time of manufacture, an efficient check during a manufacturing process is achieved.

Since the LCD 100*d* can be controlled via the address bus and the data bus, the check result of the LCD 100*d* can be supplied to software installed in a computer or to hardware such as an alarm light unit. This makes it possible to construct such a system as a circuit defect of the LCD 100*d* can be detected and reported to the outside of the system.

In the following, a description will be given with regard to an LCD of a pen-touch-input type.

As electric devices using LCDs are miniaturized, it becomes increasingly necessary to develop an LCD of a pen-touch-input type so as to allow a device to be controlled via icon operations or hand writing on the display unit by use of a pen, thereby eliminating use of a keyboard-type device. The present invention is applicable to such a pen-touch-input-type LCD.

Figure 10:
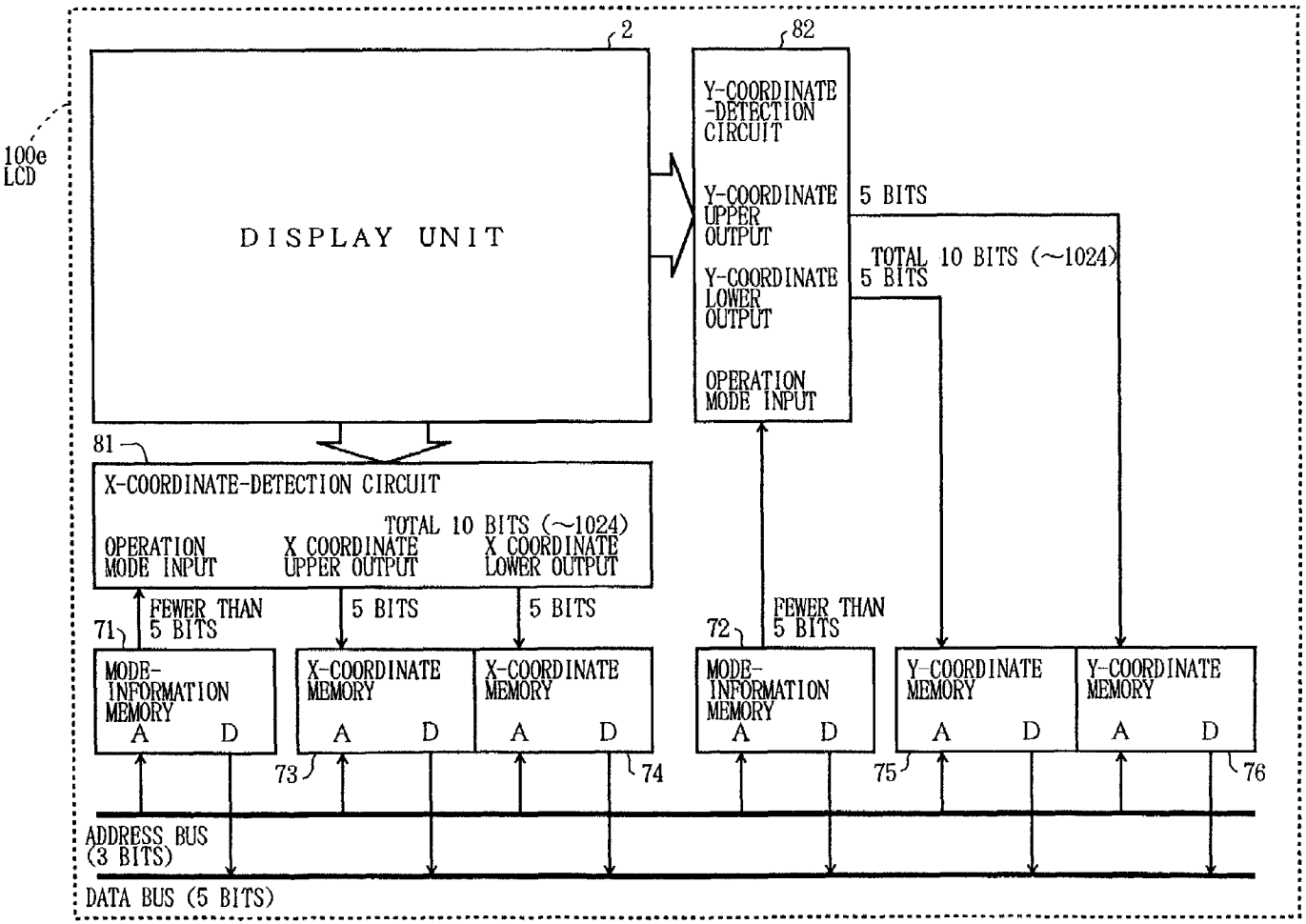
FIG. 10 is a block diagram of an LCD device of a pen-touch-input type according to a fifth embodiment of the present invention.

FIG. 10 is a block diagram of an LCD 100*e* of a pen-touch-input type according to a fifth embodiment of the present invention.

As shown in FIG. 10, the LCD 100*e* includes the display unit 2, an X-coordinate-detection circuit 81, a Y-coordinate-detection circuit 82, mode-information memories 71 and 72, X-coordinate memories 73 and 74, and Y-coordinate memories 75 and 76.

The X-coordinate-detection circuit 81 and the Y-coordinate-detection circuit 82 are connected to the display unit 2. The mode-information memory 71 and the X-coordinate memories 73 and 74 are connected to the X-coordinate-detection circuit 81, and the mode-information memory 72 and the Y-coordinate memories 75 and 76 are connected to the Y-coordinate-detection circuit 82. Each of the mode-information memories 71 and 72, the X-coordinate memories 73 and 74, and the Y-coordinate memories 75 and 76 is connected to a 3-bit address bus and a 5-bit data bus.

The display unit 2 of the LCD 100*e* is equipped with a coordinate-information-acquisition unit such as a tablet or a sensor, which supplies information pertaining coordinates of a pen touch when input is entered via such a pen touch. Based on the information pertaining coordinates, the X-coordinate-detection circuit 81 detects an X coordinate of the pen touch, and the Y-coordinate-detection circuit 82 detects a Y coordinate of the pen touch. In order to detects the coordinates, a electromagnetic induction method may be employed. In this method, loop wires are arranged on the display panel, and the X-coordinate-detection circuit 81 and the Y-coordinate-detection circuit 82 detect electric currents inducted by an alternating magnetic field emitted from the pen.

The X and Y coordinates of the pen touch detected in this manner are stored in the X-coordinate memories 73 and 74 and the Y-coordinate memories 75 and 76. Each of the X-coordinate-detection circuit 81 and the Y-coordinate-detection circuit 82 outputs a coordinate that is represented by 10 bits. The X-coordinate memory 73 and the Y-coordinate memory 75 store the 5 upper bits of the X coordinate and the Y coordinate, respectively. The X-coordinate memory 74 and the Y-coordinate memory 76 store the 5 lower bits of the X coordinate and the Y coordinate, respectively.

The X-coordinate-detection circuit 81 and the Y-coordinate-detection circuit 82 detect coordinates based on mode information stored in the mode-information memories 71 and 72, respectively. The mode information specifies accuracy of coordinate detection, a cycle of coordinate detection, etc., and is used for switching operations of the X-coordinate-detection circuit 81 and the Y-coordinate-detection circuit 82 according to usage of the device.

The coordinates stored in the respective coordinate memories are read by using the address bus and the data bus.

As described above, the present invention can implement the LCD 100*e* by employing a simple structure while making it possible to read coordinates of a pen touch that is made on the display unit 2. Since the LCD 100*e* can be controlled via the address bus and the data bus, the LCD 100*e* can be connected to a personal computer, thereby allowing the personal computer to process coordinate data obtained upon a pen touch.

The numbers of bits shown in the above are merely an example, and may be changed according to a range of coordinates, the number of bits of the mode information, etc. Further, the X-coordinate memories 73 and 74 and the Y-coordinate memories 75 and 76 do not have to be divided between the upper bits and the lower bits.

In the following, a description will be given with regard to a configuration of a memory that is of the same type as those used in the above embodiments.

Figure 11:
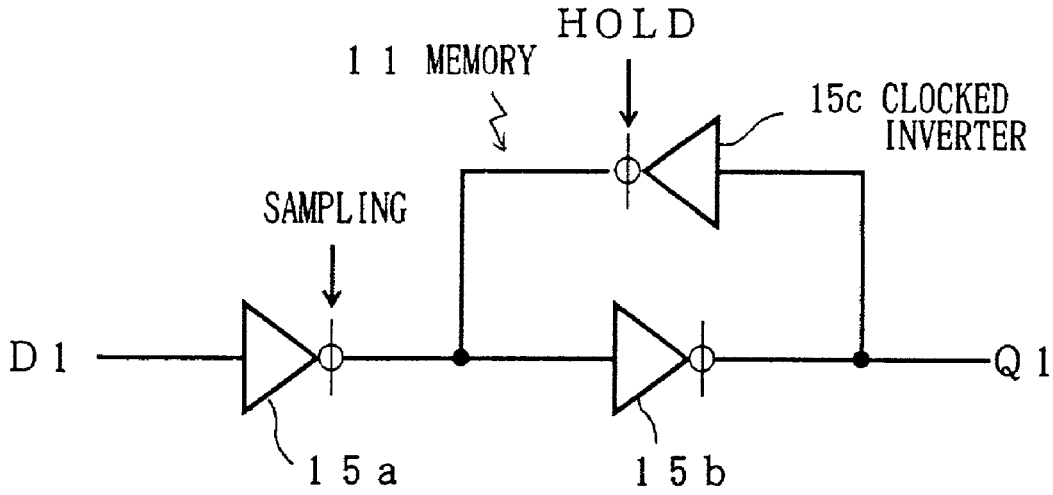
FIG. 11 is a circuit diagram of a memory comprised of a flip-flop.

FIG. 11 is a circuit diagram of a memory 11 comprised of a flip-flop.

The memory 11 includes inverters 15*a*, 15*b*, and 15*c*. When a high-level signal or a low-level signal is input to an input node D1, the memory 11 keeps a high-level output status or a low-level output status, respectively, at an output node Q1. The clocked inverter 15*c* is provided with a function of output-enable control, and can be implemented by a circuit about the same size as that of a conventional inverter.

Figure 12:
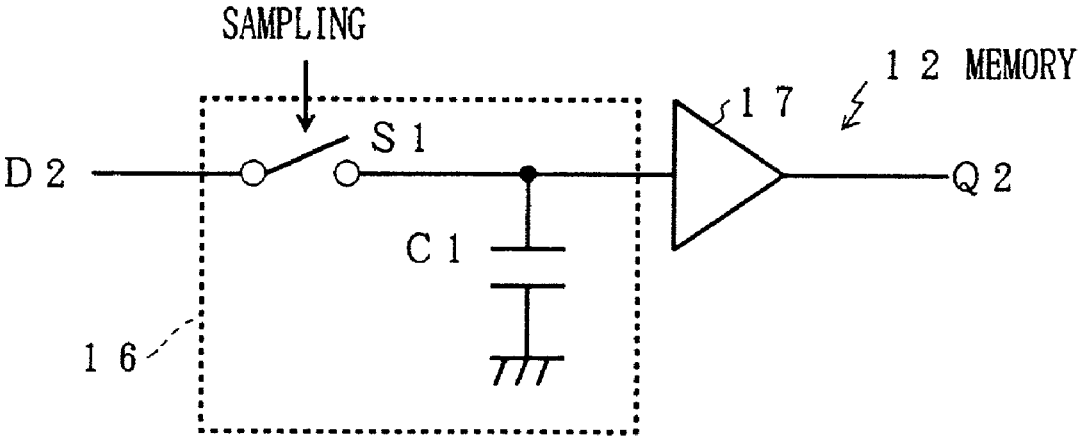
FIG. 12 is a circuit diagram of a memory comprised of a sample-hold circuit and a buffer.

FIG. 12 is a circuit diagram of a memory 12 comprised of a sample-hold circuit 16 and a buffer 17.

The buffer 17 may be implemented by using a source-follower circuit. The sample-hold circuit 16 is comprised of a switch S1 and a capacitor C1. Data supplied from an input node D2 to the switch S1 of the sample-hold circuit 16 is temporarily stored in the capacitor C1. When the data stored in the capacitor C1 is input to the buffer 17, the data comes out from an output node Q2.

Figure 13:
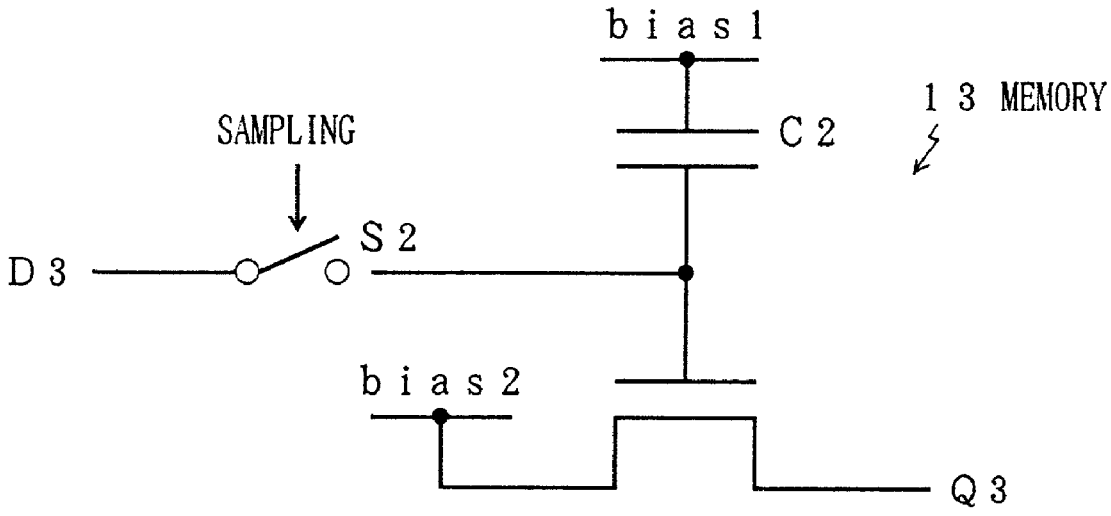
FIG. 13 is a circuit diagram of a memory comprised of a floating gate device.

FIG. 13 is a circuit diagram of a memory 13 comprised of a floating gate device.

In this circuit, a high-level voltage or a low-level voltage is stored in a capacitor C2 in advance. An on/off state of the floating gate device is controlled by the voltage level stored in the capacitor C2. When data is input to a switch S2 via an input node D3, data is output to an output node Q3 according to whether a voltage bias2 can pass through the gate.

Figure 14:
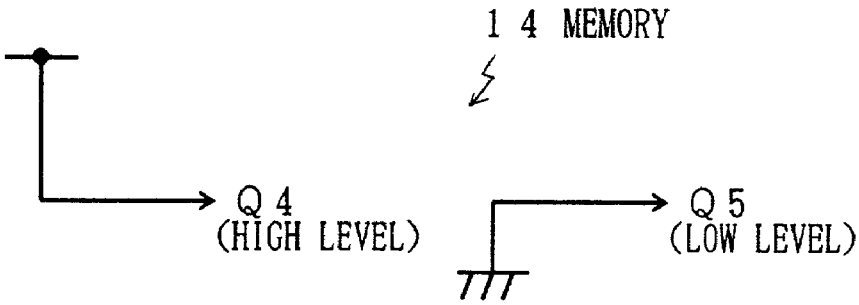
FIG. 14 is a circuit diagram of a memory implemented via a wire gate.

FIG. 14 is a circuit diagram of a memory 14 implemented via a wire gate. The memory 14 is a ROM element, and is used for storing fixed data when there is no need to rewrite the stored contents. In the memory 14, an output node Q4 is connected to a predetermined power voltage via a wire connection so as to supply a high-level output, or an output node Q5 is connected to a ground voltage level via a wire connection so as to supply a low-level output.

The memories as described above are implemented via a simple circuit structure, and, thus, can be easily employed in a polysilicon LCD, which is suitable for integrating the display unit 2 and the operation circuits together.

As a variation of the embodiments described above, a portion of the operation-circuit unit 4 such as the gate driver 40 and the data driver 50 may be provided as a separate unit external to the LCD.

Further, the present invention is not limited to these embodiments, but variations and modifications may be made without departing from the scope of the present invention.

The present application is based on Japanese priority application No. 10-141499 filed on May 22, 1998, with the Japanese Patent Office, the entire contents of which are hereby incorporated by reference.

What is claimed is:

1. A display device comprising:

a display unit which displays an image;

a display-data line which supplies data of the image from an exterior to said display unit;

memories which store information for controlling displaying of the data of the image on said display unit, said information being different from said data of the image;

an operation circuit unit which controls said display unit to display the data of the image supplied through said display-data line based on the information stored in said memories;

a data bus which connects each one of said memories to an exterior of said display device, and supplies the information to said memories from the exterior of said display device; and an address bus which connects said each one of said memories to the exterior of said display device, and supplies address signals for selecting one of said memories such that the information is written to the one of said memories selected by the address signals, wherein said operation circuit unit includes:

a gate driver which drives gate lines of said display unit; and a data driver which drives data lines of said display unit, wherein at least one of said gate driver and said data driver operates based on the information stored in said memories, wherein said memories store pattern data, said data driver operating in accordance with the pattern data stored in said memories to control said display unit to display an image corresponding to the pattern data, and wherein said operation circuit unit further includes a data-synthesis circuit which combines the pattern data stored in said memories and display data supplied from the exterior of said display device to generate synthesized pattern data, said data driver operating in accordance with the synthesized pattern data to control said display unit to display an image corresponding to the synthesized pattern data.

* * * * *